US007856914B2

(12) United States Patent
Shults et al.

(10) Patent No.: US 7,856,914 B2
(45) Date of Patent: Dec. 28, 2010

(54) NOISE SUPPRESSOR

(75) Inventors: Jonathon Shults, Sandy, UT (US); Steven Michael Pappas, Kamas, UT (US)

(73) Assignee: Silencerco, LLC, West Valley City, UT (US)

( * ) Notice: Subject to any disclaimer, the term of this patent is extended or adjusted under 35 U.S.C. 154(b) by 0 days.

(21) Appl. No.: 12/324,623

(22) Filed: Nov. 26, 2008

(65) Prior Publication Data

US 2010/0126334 A1 May 27, 2010

(51) Int. Cl.
*F41A 21/00* (2006.01)

(52) U.S. Cl. ..... 89/14.4; 89/14.2; 89/14.3; 181/223

(58) Field of Classification Search ..... 89/14.05, 89/14.1, 14.2, 14.3, 14.4, 14.5, 14.6; 42/79; 181/223

See application file for complete search history.

(56) References Cited

U.S. PATENT DOCUMENTS

| | | | | |
|---|---|---|---|---|
| 1,111,202 | A | 9/1914 | Westfall | |
| 1,341,363 | A * | 5/1920 | Fiala | 181/223 |
| 1,482,805 | A | 2/1924 | Maxim | |
| 1,605,864 | A * | 11/1926 | Steinegger | 89/14.3 |
| 2,451,514 | A * | 10/1948 | Sieg | 89/14.3 |
| 4,291,610 | A | 9/1981 | Waiser | |
| 4,588,043 | A | 5/1986 | Finn | |
| D415,813 | S | 10/1999 | O'Quinn et al. | |
| 6,079,311 | A | 6/2000 | O'Quinn et al. | |
| D435,623 | S | 12/2000 | Andrews, Jr. et al. | |
| 6,302,009 | B1 | 10/2001 | O'Quinn et al. | |
| 2007/0107590 | A1 | 5/2007 | Silvers | |

* cited by examiner

*Primary Examiner*—J. W Eldred
*Assistant Examiner*—Gabriel J Klein
(74) *Attorney, Agent, or Firm*—Ballard Spahr LLP

(57) ABSTRACT

A device for suppressing noise from a firearm. In one aspect, the suppressor has an elongate body that defines a bullet pathway extending longitudinally therethrough. The elongate body may define a plurality of adjacent chambers spaced along its longitudinal axis. The suppressor may also have at least two elongate body shells configured to selectively substantially envelop the elongate body and substantially enclose each of the adjacent chambers. The body shells of the suppressor are designed to be easily removed to clean the chambers of the suppressor.

17 Claims, 7 Drawing Sheets

NOISE SUPPRESSOR

FIELD OF THE INVENTION

This invention relates to a sound suppressor or silencer for a firearm. More particularly, the invention relates to a firearm sound suppressor which influences the expanding gases associated with the discharge of a projectile from the muzzle of a firearm in a specific fashion to abate the noise otherwise associated with the firing of the firearm.

BACKGROUND OF THE INVENTION

Firearm silencers are well known in the art of weaponry, and a variety of constructions have been proposed for minimizing the noise associated with expanding gases at the firing of a weapon. One type of silencer construction can be found by reference to U.S. Pat. No. 1,111,202 to W. E. Westfall. Westfall proposes a casing accommodating a plurality of removable funnel-shaped baffle members arranged so that their smaller openings are directed toward the muzzle of the gun muzzle. Outwardly curving faces of the baffle members are purported to act as deflecting surfaces for the exhausting gases. An alternate form of baffle member in a silencer can be found by reference to U.S. Pat. No. 1,482,805 to H. P. Maxim. Maxim uses a similar series of baffle members faced along a cylindrical casing. However, the disc-like portion of each baffle member is constructed of sheet metal having its center hole deformed by offsetting the opposite edges so that the plane of the aperture is inclined to the axis of the casing. With this arrangement, upon firing the gun to which the silencer is attached, the combustion gases are deflected by the deformed portion of the disc-like member and are directed from one chamber to the succeeding one at an angle to the passage for the projectile.

In the Waiser U.S. Pat. No. 4,291,610, a series of conical-shaped baffle members are arranged in a manner similar to that described in connection with the Westfall patent. Waiser adds an additional dimension in causing the discharged gases to decrease their energy level by providing a plurality of small holes in a partition member, with the axes of the holes being at an angle with respect to the axis of the silencer. This causes the gases passing therethrough to be directed into the mainstream of gases passing through the main aperture in the center of the silencer device. According to Waiser, the discharged gases are thus separated into a mainstream and into many auxiliary streams with the axes of the auxiliary streams crossing with the axis of the mainstream, resulting in a dispersion of the discharged gases and a decrease of their energy. While the auxiliary streams of the Waiser device are directed into the mainstream of the discharged gases, some of them are angled to direct their discharged gases into the aperture of the downstream baffle member. Accordingly, the gases passing through the auxiliary apertures do not divert the gases away from the opening of the downstream baffle member, in spite of the fact that such auxiliary streams do intersect the axis of the mainstream. Moreover, even in those embodiments which do not direct the auxiliary streams into the opening of the succeeding baffle member, only the partition member is provided with such auxiliary apertures, and the series of baffle members of the Waiser device are devoid of any auxiliary apertures.

The prior art silencers comprise a tubular sleeve that slides over the body of the silencer that contains the series of baffles. The tubular sleeve is configured to enclose the baffles and the chambers between the baffles. In use, the gases that are discharged are dispersed within the silencer. At the same time, lead and carbon deposits are also dispersed within the silencer and, as a result, build up within the silencer shot after shot. After several uses, it generally becomes necessary to clean the lead and carbon build-up from the silencer. In order to clean the lead and carbon build-up in prior art silencers, the user must slide the tubular sleeve off of the body of the silencer and to access the deposits. However, when the silencer becomes overly full with lead and carbon build-up, the build-up can get heavily packed therebetween the body of the silencer and the tubular sleeve and may put enough pressure thereon to prevent the tubular sleeve from being separated from the body of the silencer.

SUMMARY

A device for suppressing noise from a firearm is presented. In one aspect, the suppressor comprises an elongate body having a bullet entry end and an opposed bullet exit end. The elongate body defines a bullet pathway extending longitudinally there though from the bullet entry end to the bullet exit end. In one aspect, the elongate body defines a plurality of adjacent chambers that are spaced along the longitudinal axis of the elongate body. In one aspect, the chambers can be in fluid communication with each other via the fluid pathway.

In one aspect, the suppressor comprises at least two elongate body shells configured to selectively substantially envelop the elongate body and substantially enclose each of the adjacent chambers. The body shells of the suppressor are designed to be easily, which allows the deposits caused by build-up of carbon and lead from the discharge gases to be readily accessed and removed from the body of the suppressor. In yet another aspect, the suppressor further comprises an external sleeve configured to complimentarily fit over the elongate body and the elongate body shells, thereby retaining the body shells thereon the elongate body.

The suppressor also may comprise a plurality of spaced chamber baffles that are configured to separate the adjacent chambers of the elongate body. Each chamber baffle defines a baffle aperture that is coaxial with the bullet pathway. In one aspect, at least a portion of at least one of the chamber baffles lies in a plane that is transverse to the bullet pathway.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
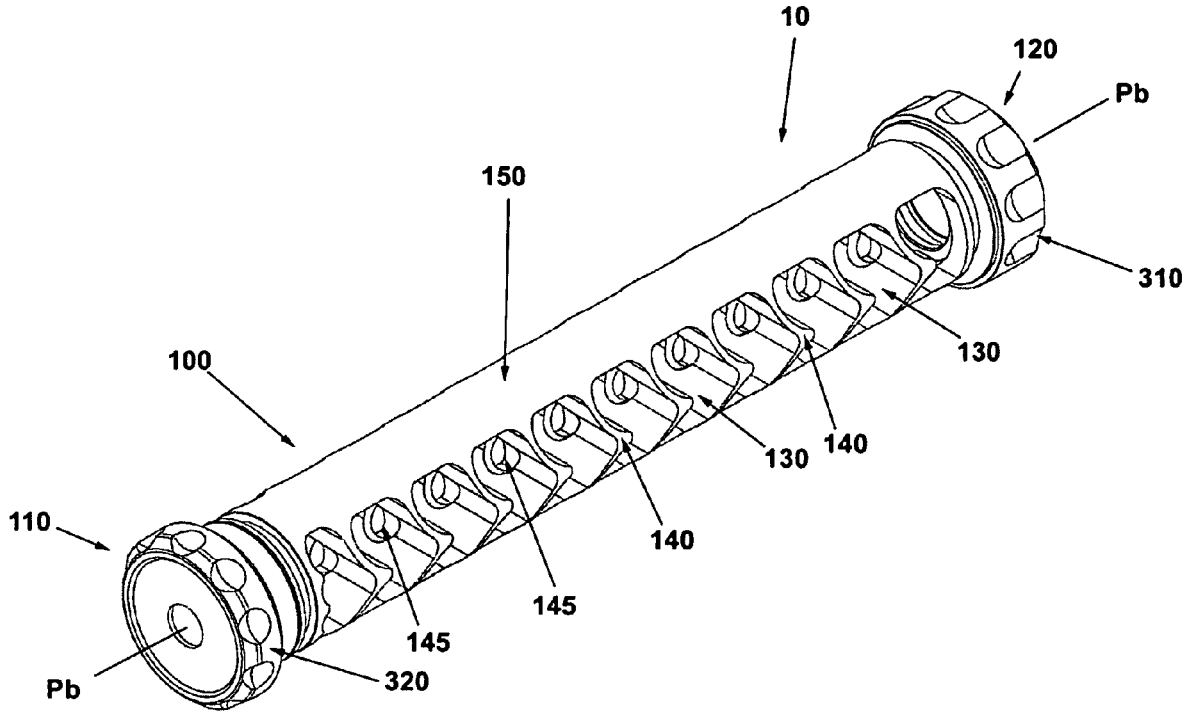
FIG. 1 is a perspective view of one embodiment of a noise suppressor for a firearm according to the present invention.
Figure 2:
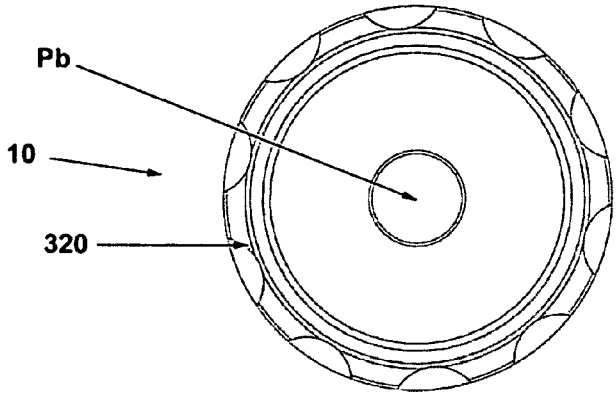
FIG. 2 is a bullet entry end of the suppressor of FIG. 1.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a baffle" can include two or more such baffles unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

A device for suppressing noise from a firearm is presented. In one aspect, the suppressor 10 comprises an elongate body 100 having a bullet entry end 110 and an opposed bullet exit end 120. The elongate body 100 defines a bullet pathway $P_B$ that extends longitudinally therethrough the elongate body from the bullet entry end 110 to the bullet exit end 120. In another aspect, the elongate body defines a plurality of adjacent chambers 130 that are spaced along the longitudinal axis $A_L$ of the elongate body. In a further aspect, the chambers 130 can be configured to be in fluid communication with each other via a fluid pathway.

As one skilled in the art will appreciate, the suppressor is configured to attach to the muzzle of a firearm such that the bullet pathway is substantially co-axial with the trajectory of the bullet as it exits the muzzle of the firearm. When the bullet exits the muzzle, it exits along with high velocity discharge gases that, in normal operation, exit the muzzle rapidly, which causes a loud noise. Noise suppressors, such as the one presented, are designed to dissipate the discharge gases that exit the muzzle of a firearm to reduce the level of noise being emitted. In the present suppressor 10, these discharge gases are dissipated via the adjacent chambers.

In one aspect, the suppressor comprises at least two elongate body shells 200 configured to selectively substantially envelop the elongate body and substantially enclose each of the adjacent chambers. Each elongate body shell has, for example, a first longitudinal edge 210 and a second, opposed longitudinal edge 220. In one aspect, the elongate body shells comprise a half tube, where the first longitudinal edge 210 of each of the pair of elongate body shells 200 is configured to mate with the second longitudinal edge 220 of the respective elongate body shell. The longitudinal edges may be keyed to compliment each other, or they may just abut one another. It is also contemplated that at least one of the pairs of longitudinal edges may comprise a hinge or similar fastening device. It is also contemplated that the body shells may comprise three or more body shells.

The body shells 200 of the suppressor are configure to be easily removed so that that the deposits caused by build-up of carbon and lead from the discharge gases can readily be accessed and removed.

As one skilled in the art will appreciate, the high velocity discharge gases that are expelled from the firearm produce large forces within the chambers 130 of the suppressor. Hence, the body shells need to be retained thereon the body of the suppressor in order to remain intact. In one aspect, it is contemplated that the body shells can be configured to selectively interlock In yet another aspect, the suppressor 10 can further comprise an external sleeve 300 configured to complimentarily fit over the elongate body 100 and the elongate body shells, thereby selectively retaining the body shells 200 thereon the elongate body.

In one aspect, the suppressor comprises a first collar 310 substantially adjacent the bullet exit end of the elongate body configured to stop and substantially abut one end of the external sleeve 300 when the external sleeve is complimentarily fit over the elongate body 100 and the elongate body shells. In another aspect, as shown in FIG. 1, the suppressor comprises a second collar 320 selectively attachable to the elongate body at the bullet entry end configured to retain the external sleeve thereon the elongate body. This collar may, for example and without limitation, be threaded onto the body of the suppressor at the bullet entry end. It should be noted that it is contemplated that the first collar 310 may also be placed at the bullet entry end, while the second collar 320 may be selectively placed on the bullet exit end.

As mentioned above, the bullet entry end is configured to selectively attach to a muzzle of the firearm. For example and without limitation, the bullet entry end 110 may comprise female threads configured to receive the complimentary male threads on the muzzle of the firearm.

Figure 3:
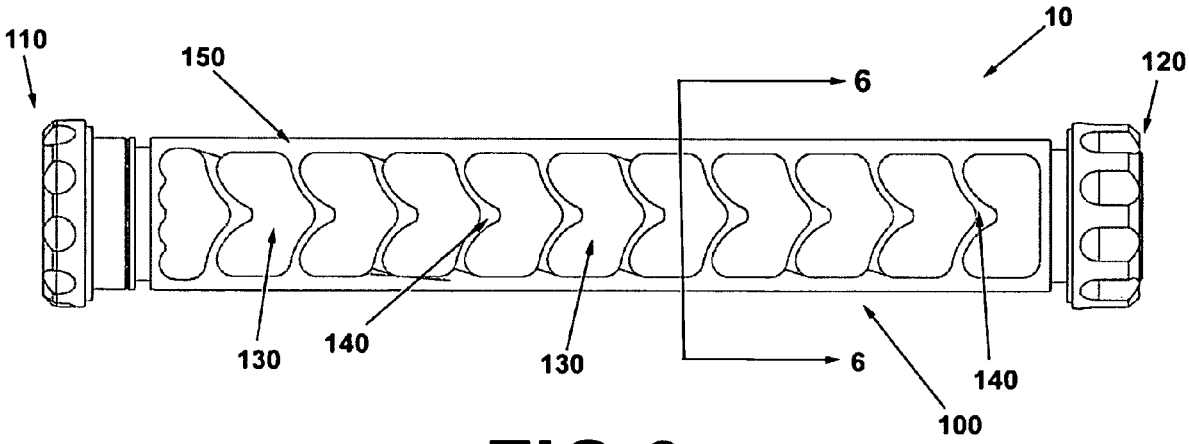
FIG. 3 is a side elevational view of the body of the suppressor of FIG. 1, showing a plurality of baffle chambers.
Figure 4:
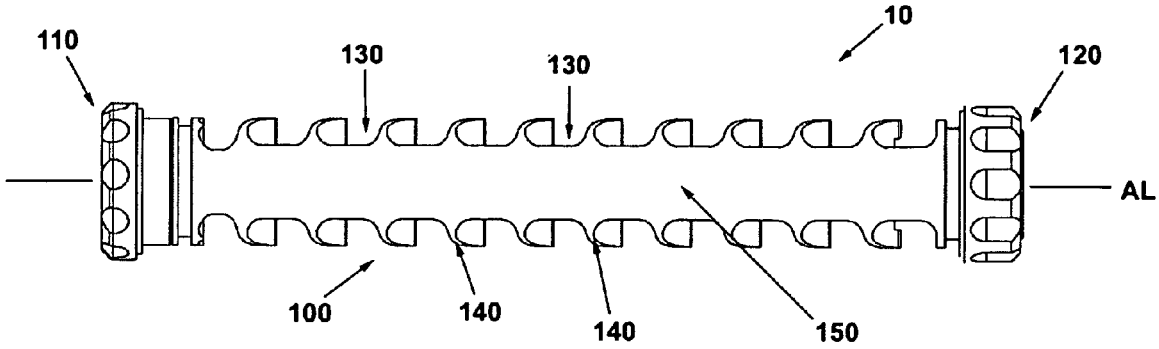
FIG. 4 is a top plan view of the body of the suppressor of FIG. 1, showing a longitudinal wall.
Figure 5:
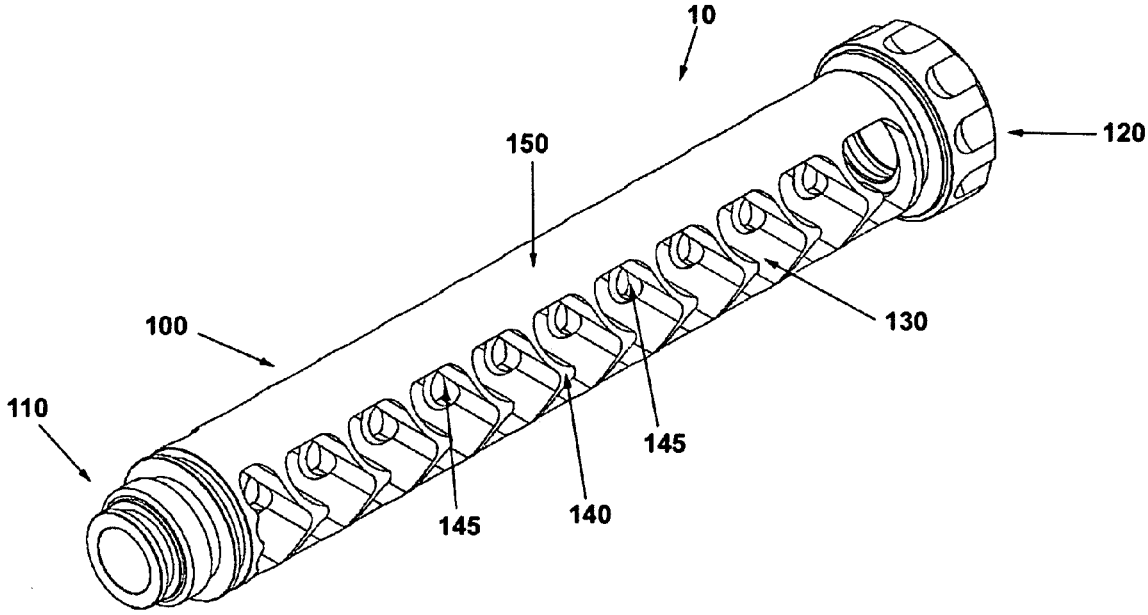
FIG. 5 is a perspective view of the suppressor of FIG. 1, shown without a second collar.
Figure 6:
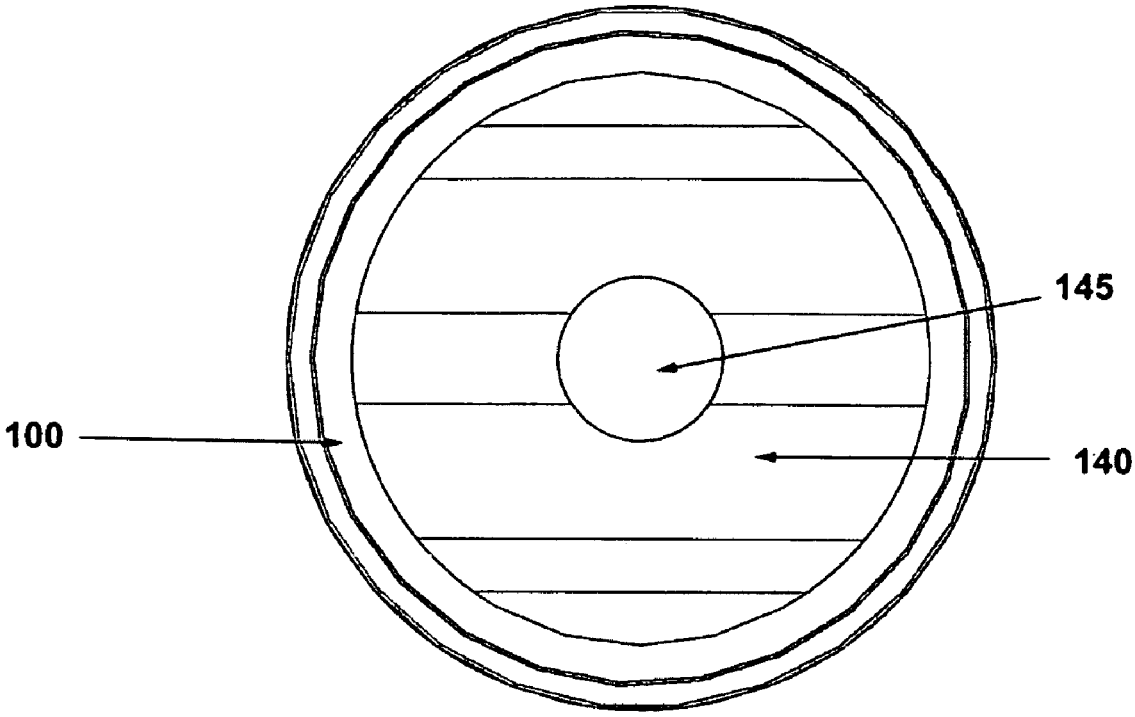
FIG. 6 is a cut away view of the suppressor of FIG. 3, cut along line 6-6.
Figure 7:
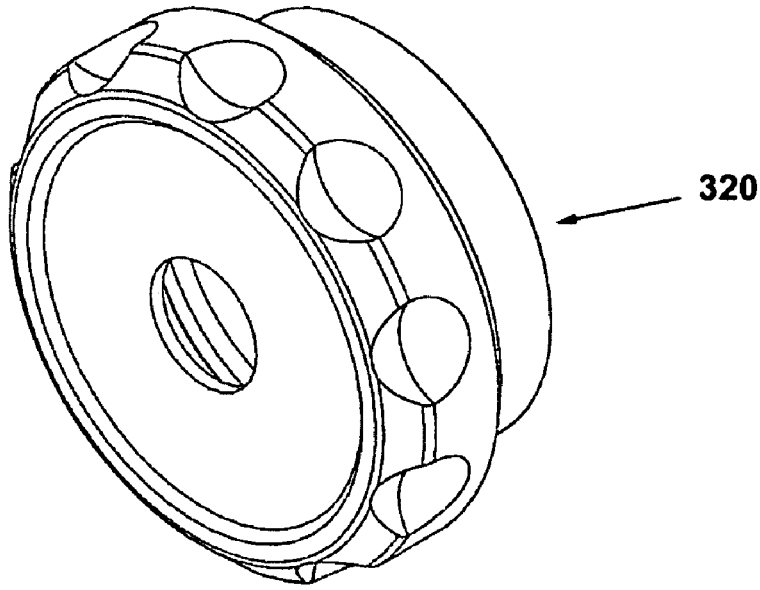
FIG. 7 is a perspective view of the second collar for the suppressor of FIG. 1.
Figure 8:
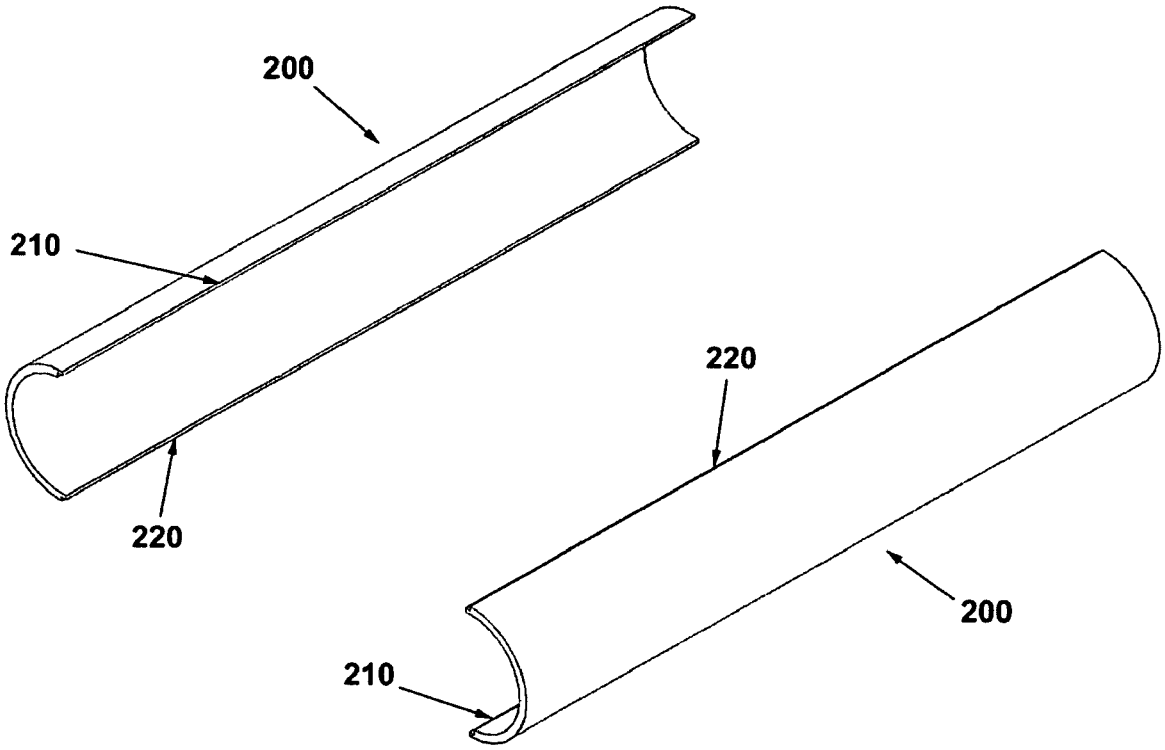
FIG. 8 is a perspective view of a pair of shells for use in the suppressor of FIG. 1.
Figure 9:
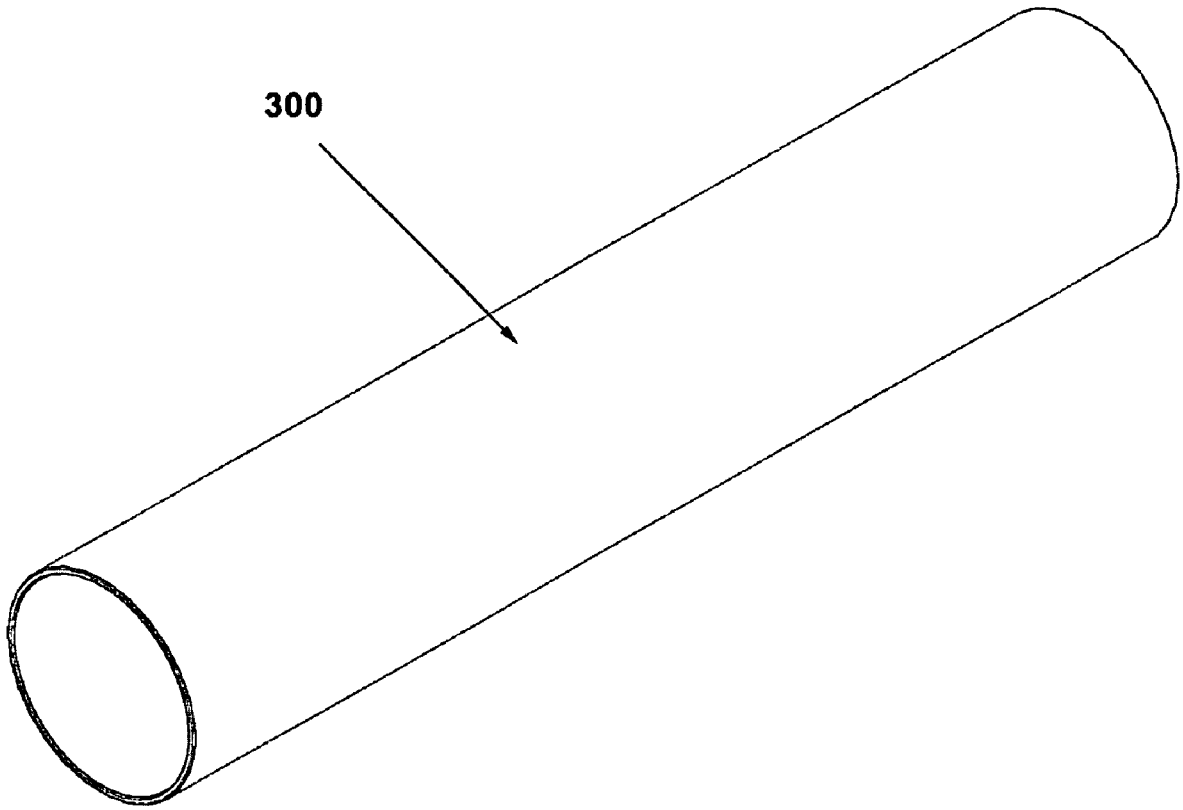
FIG. 9 is a sleeve for use with the suppressor of FIG. 1.
Figure 10:
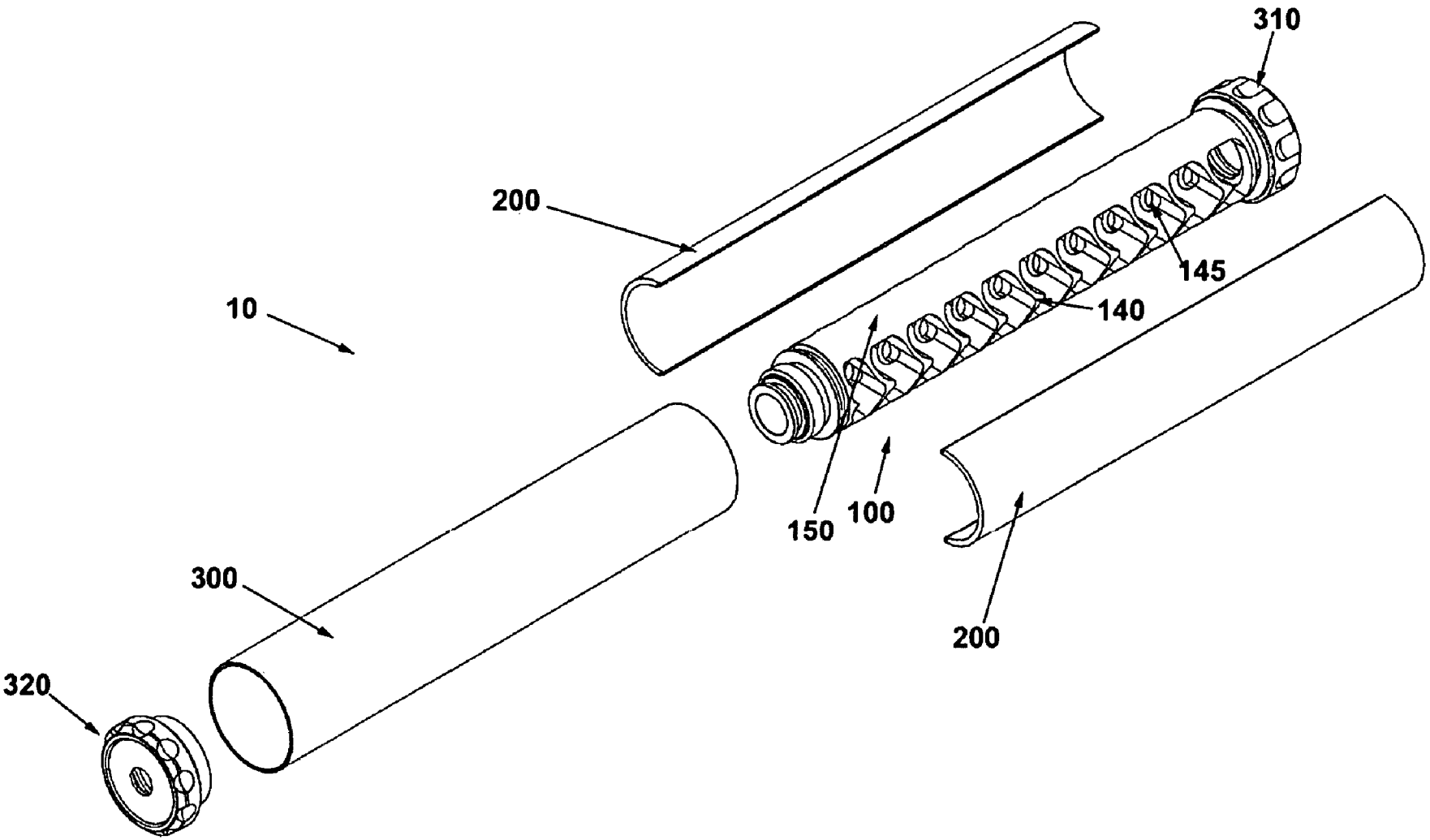
FIG. 10 is an exploded perspective view of the suppressor of FIG. 1.

As can be seen in the figures, the elongate body of the suppressor 10 can comprise a plurality of spaced chamber baffles 140 separating each of the chambers. Each chamber baffle defines a baffle aperture 145 that is coaxial with the bullet pathway $P_B$. In one aspect, at least a portion of at least one of the chamber baffles 140 can be positioned to lie in a plane that is substantially transverse to the bullet pathway. In another aspect, at least a portion of at least one of the chamber baffles can be substantially frustoconical in shape. In yet another aspect, as shown in FIG. 3, at least a portion of at least a portion of at least one of the chamber baffles can be positioned at an acute angle relative to the bullet pathway. It should be noted that many other shapes are contemplated for the chamber baffles, such as, for example and without limitation, a pyramid, a wafer, and the like.

Referring to FIG. 1, the elongate body may also comprise at least two longitudinal walls 150 that extend from the bullet entry end to the bullet exit end. In this aspect, each of the chamber baffles 140 are connected to and supported by at least one of the longitudinal walls 150.

In one aspect, the first longitudinal edge of one of the at least two elongate body shells and the second longitudinal edge of an adjacent elongate body shell can be configured to substantially overly at least a portion of one of the at least two longitudinal walls. In this aspect, the junction of the respective longitudinal edges can be configured to longitudinally overlie the longitudinal walls.

The drawings of the suppressor show the shape of the suppressor to be cylindrical. While this is the obvious choice from a design standpoint, it is certainly not the only shape that is contemplated. Just about any shape for the body 100 will work.

Additionally, in one aspect, the materials of construction for the suppressor comprise aluminum. However, other materials are also contemplated, such as, for example and not meant to be limiting, alloy steel, titanium, stainless steel, carbon fiber, other reinforced composite materials, and the like.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

We claim:

1. A suppressor for a firearm, comprising:

an elongate body having a bullet entry end, an opposed bullet exit end, and a longitudinal axis, wherein the elongate body defines a bullet pathway extending longitudinally therethough from the bullet entry end to the bullet exit end, wherein the elongate body further comprises a plurality of spaced baffles that extend across the bullet pathway, wherein each baffle defines a baffle aperture that is coaxial with the bullet pathway, and wherein the plurality of spaced baffles of the elongate body defines a plurality of adjacent chambers spaced along the longitudinal axis of the elongate body;

at least two elongate substantially semi-circular body shells, each elongate body shell having a first longitudinal edge, a second, opposed longitudinal edge, and a continuous inner surface, wherein the respective inner surfaces of the at least two elongate body shells are configured to selectively substantially envelop the elongate body and substantially hermetically enclose each of the adjacent chambers of the elongate body; and an external sleeve configured to complimentarily fit over the elongate body and the elongate body shells, thereby retaining the body shells thereon the elongate body.

2. The suppressor of claim 1, wherein the at least two elongate body shells comprise a pair of elongate body shells.

3. The suppressor of claim 2, wherein each elongate body shell comprises a half tube, wherein the first longitudinal edge of each of the pair of elongate body shells is configured to mate with the second longitudinal edge of the respective elongate body shell.

4. The suppressor of claim 1, comprising a first collar substantially adjacent the bullet exit end of the elongate body configured to stop and substantially abut one end of the external sleeve when the external sleeve is complimentarily fit over the elongate body and the elongate body shells.

5. The suppressor of claim 4, comprising a second collar selectively attachable to the elongate body at the bullet entry end configured to retain the external sleeve thereon the elongate body.

6. The suppressor of claim 1, comprising a first collar substantially adjacent the bullet entry end of the elongate body configured to stop and substantially abut one end of the external sleeve when the external sleeve is complimentarily fit over the elongate body and the elongate body shells.

7. The suppressor of claim 6, comprising a second collar selectively attachable to the elongate body at the bullet exit end configured to retain the external sleeve thereon the elongate body.

8. The suppressor of claim 1, wherein the bullet entry end is configured to selectively attach to a barrel of the firearm.

9. The suppressor of claim 1, wherein each baffle substantially separates the adjacent chambers.

10. The suppressor of claim 9, wherein at least a portion of at least one of the baffles lies in a plane that is transverse to the bullet pathway.

11. The suppressor of claim 9, wherein at least one of the baffles is substantially frustoconical in shape.

12. The suppressor of claim 9, wherein at least a portion of at least one of the baffles is at an acute angle relative to the bullet pathway.

13. The suppressor of claim 9, wherein the elongate body comprises at least two longitudinal walls that extend from the bullet entry end to the bullet exit end, and wherein each of the baffles are connected to at least one of the longitudinal walls.

14. The suppressor of claim 13, wherein the first longitudinal edge of one of the at least two elongate body shells and the second longitudinal edge of an adjacent elongate body shell substantially overly at least a portion of one of the at least two longitudinal walls.

15. The suppressor of claim 1, wherein the suppressor is substantially cylindrical.

16. The suppressor of claim 1, wherein the elongate body comprises aluminum.

17. The suppressor of claim 1, wherein the elongate body comprises carbon fiber.

* * * * *